US008945315B2

(12) United States Patent
Grüll et al.

(10) Patent No.: US 8,945,315 B2
(45) Date of Patent: Feb. 3, 2015

(54) DISHWASHER HAVING TWO WATER CONNECTIONS AND CONTROL METHOD

(75) Inventors: Franz Grüll, Königsbronn (DE); Heinz Heißler, Dillingen (DE); Anton Oblinger, Gersthofen (DE); Roland Rieger, Rainau (DE); Michael Georg Rosenbauer, Reimlingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 70 days.

(21) Appl. No.: 13/376,388

(22) PCT Filed: Sep. 7, 2009

(86) PCT No.: PCT/EP2009/061578

§ 371 (c)(1),
(2), (4) Date: Dec. 6, 2011

(87) PCT Pub. No.: WO2010/142351

PCT Pub. Date: Dec. 16, 2010

(65) Prior Publication Data

US 2012/0125373 A1 May 24, 2012

(30) Foreign Application Priority Data

| | | |
|---|---|---|
| Jun. 10, 2009 | (DE) | 10 2009 026 876 |
| Jun. 10, 2009 | (DE) | 10 2009 026 877 |
| Jun. 10, 2009 | (DE) | 10 2009 026 878 |
| Jun. 10, 2009 | (DE) | 10 2009 026 879 |
| Jun. 10, 2009 | (DE) | 10 2009 026 887 |
| Jun. 10, 2009 | (DE) | 10 2009 026 904 |
| Jun. 10, 2009 | (DE) | 10 2009 026 911 |
| Sep. 2, 2009 | (DE) | 10 2009 029 148 |
| Sep. 3, 2009 | (DE) | 10 2009 039 847 |

(51) Int. Cl.
*B08B 9/20* (2006.01)
*B08B 7/04* (2006.01)

(Continued)

(52) U.S. Cl.
CPC ..... *A47L 15/4217* (2013.01); *A47L 15/0007* (2013.01); *A47L 15/0028* (2013.01);
(Continued)

(58) Field of Classification Search
USPC ..... 134/25.2, 42, 56 R, 57 D, 58 D, 201
See application file for complete search history.

(56) References Cited

U.S. PATENT DOCUMENTS 4,356,812 A * 11/1982 Haven ..... 126/572
6,848,140 B2 * 2/2005 Cho ..... 8/159

(Continued)

FOREIGN PATENT DOCUMENTS

CH 576091 A5 5/1976
DE 3023355 A1 1/1982

(Continued)

OTHER PUBLICATIONS

Machine Translation of JP2002-291681 by Aoyanagi et al., published on Oct. 8, 2002.*

(Continued)

*Primary Examiner* — Eric Golightly
*Assistant Examiner* — Arlyn I Rivera-Cordero
(74) *Attorney, Agent, or Firm* — James E. Howard; Andre Pallapies

(57) ABSTRACT

A dishwasher includes a hot water inlet device for intake of hot water from an external hot water supply and a cold water inlet device for intake of cold water from an external cold water supply. A program control device controls a wash cycle of a selected dishwashing program for cleaning wash items. The program control device is constructed to operate in at least one of first and second operating modes, wherein the first operating mode includes activation of one wash program which, in at least one partial wash cycle of a wash cycle, draws hot water from the external hot water supply, and wherein the second operating mode includes activation of another wash program which, in at least one partial wash cycle of a wash cycle, exclusively draws cold water from the external cold water supply.

26 Claims, 4 Drawing Sheets

(51) Int. Cl.
*B08B 3/00* (2006.01)
*A47L 15/42* (2006.01)
*A47L 15/00* (2006.01)

(52) U.S. Cl.
CPC ..... *A47L15/0047* (2013.01); *A47L 15/0002* (2013.01); *A47L 2301/04* (2013.01); *A47L 2401/03* (2013.01); *A47L 2401/06* (2013.01); *A47L 2501/01* (2013.01); *A47L 2501/30* (2013.01)
USPC ..... 134/25.2; 134/18; 134/56 D; 134/57 D; 134/94.1; 134/98.1

(56) References Cited

U.S. PATENT DOCUMENTS 7,524,380 B1 * 4/2009 Duri et al. ..... 134/18
2002/0040941 A1 * 4/2002 Wiemer et al. ..... 239/226
2006/0260656 A1 * 11/2006 Berner et al. ..... 134/56 D

FOREIGN PATENT DOCUMENTS

DE 10057263 A1 5/2002
DE 10226736 A1 1/2003
DE 20319404 U1 3/2005
DE 202005019491 U1 2/2006
EP 1902658 A1 3/2008
JP 2002-291681 * 10/2002 ..... A47L 15/42

OTHER PUBLICATIONS

International Search Report PCT/EP2009/061578, Date:Jul. 16, 2010.

* cited by examiner

DISHWASHER HAVING TWO WATER CONNECTIONS AND CONTROL METHOD

BACKGROUND OF THE INVENTION

The present invention relates to a dishwasher, particularly a domestic dishwasher, comprising a hot water inlet device for the intake of hot water from an external hot water supply, a cold water inlet device for the intake of cold water from an external cold water supply, and a program control device for controlling a wash cycle of a selected dishwashing program for cleaning food-soiled wash items.

In modern dishwashers, the wash items, in particular wash items requiring to be washed, are placed into a wash chamber and cleaned therein in a washing process, also designated a wash cycle, with the aid of water and are subsequently dried. The respective wash cycle can, in particular, comprise one or more partial wash cycles or wash cycle steps. The aim therein is to carry out a wash cycle such that a predefined cleaning result and a predefined drying result are achieved as efficiently as possible. A high degree of overall efficiency resulting from the cleaning efficiency and the drying efficiency is required. The cleaning efficiency corresponds to the ratio of the cleaning result achieved by means of a wash cycle to the effort required therefor, wherein the effort can involve several dimensions, such as energy usage, water usage and/or the time taken. Furthermore, the drying efficiency corresponds to the ratio of the drying result achieved by means a wash cycle to the effort required therefor, wherein here also the effort can involve several dimensions, such as the energy usage and/or the time taken.

Normally a program control device is provided in a dishwasher, wherein one or more wash programs, each for controlling at least one wash cycle for cleaning wash items, are stored. The program control device is embodied so as to control a wash cycle automatically in accordance with a program which is typically selected by a user. In known dishwashers, the water required for performing wash cycles can be fed in via a water inlet device which can take in water from a water supply installed in a building, for example.

In order to perform a wash cycle, a wash program preferably has a plurality of program steps in sequence for treating the wash items, the water being brought, in the program steps using water, to a temperature favorable for the respective program step, and provided with cleaning and/or additive substances depending on the respective program step. In order to be able to provide the water for washing with the cleaning and/or additive substances provided, modern dishwashers usually have automatic dosing devices. Dishwashers can also comprise a, typically electric, heating device to bring the water provided for washing to the required temperature.

For cleaning the wash items, a typical wash program comprises, in the following chronological order, in particular, a pre-wash step for performing a pre-wash cycle, a cleaning step for performing a cleaning cycle, an intermediate rinsing step for performing an intermediate rinsing cycle, and a final rinsing step for performing a final rinsing cycle in which the wash items have water or wash liquor solution applied to them. However, wash programs can also be provided in which one or more of these program steps are omitted. Wash programs are also possible wherein one or more of said program steps are repeated multiple times. Furthermore, a typical wash program comprises a drying cycle following on from the last partial wash cycle using water, said drying cycle being performed by a corresponding drying step of the selected dishwashing program, in order to dry the cleaned wash items.

A pre-wash step serves primarily to remove heavier soiling from the wash items. The purpose of a subsequent cleaning step is the complete removal of dirt from the wash items. An intermediate rinsing step serves, in particular, to remove cleaning agent residues adhering to the wash items. A subsequent final rinsing step is provided, in particular, to prevent spots that can occur on the wash items due to dissolved substances in the water, such as salt and/or lime. For this purpose rinse aid is added to the water during the final rinsing step.

In a dishwasher with integrated drying function, a further aim of the final rinsing step is to prepare for the subsequent drying step. For this, the wash items are heated to a high temperature during the final rinsing step.

In the subsequent drying step, water drops adhering to the hot wash items evaporate and condense on the inside of the wash chamber due to the lower temperature prevailing thereon.

DE 100 46 347 A1 discloses a water inlet device for domestic appliances such as a dishwasher which comprises a cold water valve and a hot water valve. Both the cold water valve and the hot water valve can be opened or closed by means of a control device depending on an operating program. Arranged downstream of the cold water valve and downstream of the hot water valve, in each case, is a water feed hose which ends in a branch connector. The sole outlet of the branch connector is connected to a water inlet fixed to the housing of the dishwasher. By this means the hot water needed by the dishwasher can be drawn from a hot water supply line, the water of which is heated by a domestic heating system.

DE 100 57 263 mentions a hot water supply for a domestic appliance which has solar collectors for hot water provision.

It is beyond question that the use of hot water from a domestic heating system can result in a saving of electrical energy, since in such a case the energy requirement of an electrical heater of the dishwasher can be reduced. Against the background of generally increasing operating costs of domestic heating systems, the additional costs incurred for operation of the domestic heating system that are associated with the drawing of hot water from the domestic hot water supply in many cases exceed the electricity cost saving.

BRIEF SUMMARY OF THE INVENTION

It is an object of the present invention to provide a dishwasher which incurs lower energy costs in operation.

The object is achieved with a dishwasher, particularly a domestic dishwasher, of the type cited in the introduction in that the program control device has a first operating mode in which at least one wash program can be activated which, in at least one partial wash cycle of a wash cycle, specifically makes provision for a drawing of hot water from the external hot water supply, and/or that the program control device has a second operating mode in which at least one wash program can be activated which, in at least one partial wash cycle of a wash cycle, specifically makes provision exclusively for a drawing of cold water from the external cold water supply.

By this means a dishwasher with improved efficiency can be provided.

According to an advantageous development of the invention, the hot water feed is carried out for the uptake of hot water from an external hot water supply. Said supply can be fed in particular at least partially from a thermal solar installation. A thermal solar installation is a technical system for converting solar energy into usable heat energy. Thermal solar systems usually provide hot water in a temperature range from, for example, 40° C. to 70° C., making direct use of the hot water for building heating and for domestic use. Thermal solar installations usually comprise a plurality of solar collectors which have an absorber surface which is heated by the electromagnetic solar radiation. From there the heat can be transported by means of a liquid to a heat exchanger which generates the hot water, in a buffer store which is filled with water, for example.

Under favorable conditions and given a temperate climate, the hot water needs of a household can be met with collector surfaces of a few square meters. The associated generation costs for the heat energy obtained are extremely small. However, in many locations, in central Europe for example, during the winter months or in periods of poor weather during summer or where there is a large hot water requirement, the output of solar collectors is insufficient. Therefore, in many cases, solar installations have additional conventional auxiliary heating, for example, gas- or oil-fired heating, in order to make sufficient hot water available in such situations. If, however, it is necessary to have recourse to such auxiliary heating, then the cost of the generated hot water provided usually increases. In particular, in place of or in addition to a thermal solar installation, a modern condensing boiler system such as a pellet furnace, wood-chip or log-burning heating system, combined heat and power system, geothermal heat pump system, air-source heat pump system, district or local heating plants, either individually or in any combination, etc. may be more suitable for providing a cost-effective hot water supply in a household. In particular, the linking of, for example, a pellet furnace to a thermal solar installation may be energetically advantageous. Also energetically favorable are, in particular, other hot water supply systems that require no, or only relatively little, primary energy input from fossil fuels and/or use only, or largely, $CO_2$-neutral or $CO_2$-reduced energy sources. If some other—possibly conventional—hot water supply system is present or available, the statements made above in relation to thermal solar hot water production installations apply analogously with regard to the embodiment and control of the dishwasher according to the invention.

The dishwasher according to the invention therefore advantageously enables the efficient use of hot water from an external hot water supply system, particularly hot water produced cost-effectively by means of a solar installation.

For this purpose the program control device has a first operating mode in which at least one wash program can be activated which makes provision for the use of hot water from the hot water supply during a wash cycle, and wherein the program control device has a second operating mode in which at least one wash program can be activated which makes provision exclusively for the use of cold water from the cold water supply during a wash cycle. The first operating mode therefore involves hot water operation in which hot water from the external hot water supply system which is powered or assisted in particular by thermal solar energy is at least partially used for a wash cycle, whereas the second operating mode involves solely cold water operation in which only cold water from the external cold water supply system is used.

The first operating mode enables efficient performance of wash cycles when the cost saving due to the reduction of the internal heating requirement of the dishwasher is greater than the additional cost of operation of the external hot water supply system due to the drawing of hot water. The second operating mode, in contrast, enables efficient performance of wash cycles when the cost saving due to the reduction in the internal heating requirement of the dishwasher is lower than the additional cost of operating the hot water supply due to the drawing of hot water.

It is possible in this case for example to adapt the sequence of wash cycles to the heating power provided by the external hot water supply or hot water supply system, particularly to the power generated by the solar collectors, without a change to the installation in the building or to the connection of the dishwasher to the installation in the building being required. In particular, it is not necessary to change connection hoses of the dishwasher to the building-side connections depending on the requirement to draw hot water or cold water, i.e. to connect or separate said connections therefrom. After all, the dishwasher embodied according to the invention now has in particular a first connection hose for drawing hot water and a second connection hose for cold water, i.e. said dishwasher is equipped with a bithermal water connection device. The two connection hoses of said bithermal water connection device can in particular remain permanently connected to the hot water connection of the external hot water supply and to the cold water connection of the external cold water supply without changing the connection assignment.

If the external hot water supply, in particular the solar collectors, provides an excess of heat relative to the other requirements of the household, then said excess can be used in a simple manner to reduce the internal energy requirement of the dishwasher in that the first operating mode is selected. If, on the other hand, the external hot water supply system, in particular the solar collectors, supplies too little heat relative to the heat requirements of the household, then by selecting the second operating mode it is possible to prevent the drawing, from the hot water supply, of heat that would have to be compensated for by heating with the usually more expensive auxiliary heating function of the hot water supply system.

The wash programs that can be activated on selection of the first operating mode are, with regard to the chronological sequence thereof, particularly adapted specifically to the use of hot water from the external hot water supply system, particularly the thermal solar installation. Similarly, on selection of the second operating mode, the wash programs that can be activated are particularly adapted specifically to the use of cold water. In both cases, a predetermined cleaning effect or drying effect can be achieved with high efficiency.

In the first operating mode and the second operating mode, corresponding wash programs can be provided which are broadly similar, particularly in having an essentially identical cleaning effect and/or drying effect. For example, corresponding normal wash programs, corresponding intensive programs, corresponding delicate items programs or corresponding automatic programs can be provided. The corresponding programs can alternatively or additionally be embodied as quick-wash programs.

According to a particularly beneficial development of the invention, in the first operating mode, at least one wash program can be activated which provides at least one program step for washing wash items using hot water from the hot water supply.

Insofar as a program step makes it necessary or at least desirable, due to the nature thereof, to use water at a high temperature, hot water can be drawn from the external water supply for said program step in the first operating mode. A program step of this type for washing wash items can be in particular a cleaning step and/or a final rinsing step since it is normally therein provided that relatively hot water is applied to the wash items. The drawing of hot water can in this case take place before or during the respective program step.

Drawing hot water for a program step of this type is in particular more energy-efficient and cost-efficient than drawing cold water when the external water supply system, particularly a thermal solar installation, provides sufficient heat energy. The reason for the increased cost efficiency lies in the fact that, on drawing hot water, the internal electrical energy requirement of the dishwasher falls significantly for at least one partial wash cycle of the wash cycle of a selected dishwashing program, due to a reduced electrical energy requirement for heating the drawn-in water. This can lead to a significant reduction in the power costs of the household. By this means, an efficiency increase relative to a dishwasher provided exclusively for connection to a cold water supply can be achieved.

According to an advantageous development of the invention, it is provided that in the first operating mode, at least one wash program can be activated which additionally provides, in at least one program step of the respective selected dishwashing program, i.e. in at least one partial wash cycle of the associated wash cycle, for the use of cold water from the cold water supply. Therefore, it can be particularly beneficial if the program control device is embodied and coupled to the hot water inlet device and the cold water inlet device such that for a first group of partial wash cycles of the wash cycle of a selected dishwashing program for each of which a specific wash bath hot water temperature higher than the temperature of the cold water from the external cold water supply is required, hot water can be fed from the external hot water supply via the hot water inlet device into the wash chamber, specifically to the partial wash cycle, and that for a second group of partial wash cycles of the wash cycle of the selected dishwashing program, cold water can be fed from the external cold water supply via the cold water inlet device into the wash chamber, specifically to the partial wash cycle. This advantageous exemplary embodiment involves, in the case of the first operating mode, combined hot and cold water operation. Through the at least partial use of cold water from the external cold water supply it is possible, for the partial wash cycles of such program steps in which the use of water at a higher temperature brings no advantages or even disadvantages, to draw cold water from the cold water supply. It is thus possible to achieve an energy efficiency enhancement for the dishwasher according to the invention. In this case also, the drawing of cold water can take place before or during the respective partial wash cycle. In particular, the use of cold water for the partial wash cycles "pre-wash" and "intermediate rinsing" is beneficial.

As distinct from a dishwasher which is exclusively provided for connection to a hot water supply, washing technology-related disadvantages which can arise due to the compulsory use of hot water in special program steps can thus be prevented. Furthermore, by means of the partial drawing of cold water from the external cold water supply, the quantity of hot water that must be drawn from the external hot water supply for a wash cycle can be reduced without substantial disadvantages having to be accepted in respect of the cleaning effect and/or the drying effect. In this way, it can be ensured in the first operating mode that the total quantity of hot water that must be drawn from the external hot water supply system, particularly the thermal solar installation, during the performance of a wash cycle is limited to a maximum value. In this way, the first operating mode can also be beneficially selected when the external hot water supply, particularly the solar collectors thereof, supply relatively little heat energy.

Overall, therefore, in the first operating mode, one or more wash programs are possible for controlling a respective wash cycle, each providing the performance of individual program steps, for example, pre-wash step, intermediate rinsing step, with specific use of hot water from the external hot water supply and the performance of other program steps with specific use of cold water from the external cold water supply system. In this way a significant efficiency improvement can be achieved both compared with known dishwashers which—as is usual above all in Europe—are provided exclusively for connection to a cold water supply, and compared with known dishwashers which—as is usual above all in North America—are provided exclusively for connection to a hot water supply.

Furthermore, it can be particularly beneficial if with specific, i.e. individually assigned intake of hot water from the external hot water supply system for a first group of one or more partial wash cycles of the respectively running wash cycle and of cold water from the external cold water supply system for a second group of one or more partial wash cycles, an externally provided heat exchanger, particularly in the form of a water pocket or reservoir mounted on a wall, particularly a side wall, of the wash chamber, in heat-transmitting manner, for example, by contact, is filled with cold water from the external cold water supply system at the end of the final rinsing cycle and/or at the start of the subsequent drying cycle. In this way the wall surface of the wash chamber in contact with the heat exchanger can be cooled for example during the drying process and the condensation of liquid on the inner surface of the wall of the wash chamber provided externally with the heat exchanger can be improved, so that consequently an improved drying result is produced.

In the event that, for all the wash cycles of the selected dishwashing program that use water, hot water from the external hot water supply system is used since, for example, no cold water connection, but only a hot water connection is available, or because via the operator control device of the dishwasher, particularly by manual actuation of the auxiliary button for external hot water intake, a wash program is selected which provides only hot water intake for all the partial wash cycles thereof, then it is beneficial if the heat exchanger is not filled with hot water at the end of the final rinsing cycle, but remains empty throughout the duration of the drying cycle. In this way impairment of the condensation process in the wash chamber due to an additional quantity of hot water is prevented. Also prevented thereby is the possibility of hot water being drawn into the heat exchanger at the end of the final rinsing cycle, cooling down to ambient temperature by the time the next wash program is about to start, and subsequently being supplied as water "gone cold" to the wash bath for the pre-wash cycle of the next wash program, which would lead to impairment of a possibly desired heating process during the pre-wash cycle.

As soon as the user deactivates the hot water intake with the operator control device of the dishwasher, particularly an auxiliary function button provided therefor, the program control device ensures in particular that only cold water is drawn in from the cold water supply for the wash baths in all the partial wash cycles of the wash cycle of the selected dishwashing program. For the partial wash cycles for the respective wash bath quantity of which a specific minimum temperature higher than the cold water temperature is required, the cold water to be introduced for the respective wash bath is heated by means of the heating device of the fluid flow system, particularly the circulation pump, of the dishwasher and brought to the desired specific minimum temperature.

According to a beneficial development of the invention, an operator control device is provided which enables manual selection of the operating mode. An operator control device of this type enables the user personally to decide whether hot water should be used partially or exclusively, or whether only cold water will be taken in. The operator control device can be an additional button arranged on the control panel of the dishwasher. However, it is also possible, for switching over the operating mode, to provide operator control devices such as, for example, multifunction buttons, rotary knobs, touch-screens, alphanumeric input units and so forth. An additional button of this type can also be provided, for example, for other operator interventions for the monitoring and control of the dishwasher.

According to a beneficial development of the invention, the dishwasher has, in particular, a data interface provided for receiving operating data of the external hot water supply system, particularly a thermal solar installation. In this case the program control device can be embodied for automatic selection of the operating mode based on received operating data. Said operating data can be, for example, information concerning the power output of solar collectors or information concerning the heat quantity stored in a heat accumulator, particularly a buffer store, of a thermal solar installation. By this means, automatic selection of the more efficient operating mode in a particular case is possible.

According to a preferred development of the invention, it is particularly provided that the hot water inlet comprises a hot water valve and the cold water inlet comprises a cold water valve, wherein the hot water valve and the cold water valve are controllable independently of one another, i.e. individually by means of the program control device of the dishwasher. It is thus readily possible to carry out the drawing of hot water from the hot water supply system and/or cold water from the external cold water supply system, specifically to the partial wash cycle, as provided by the wash programs of the two operating modes. In particular, an external device for controlling the water intake can be dispensed with.

According to a beneficial development of the invention, it is provided that the hot water valve is arranged at an upstream end of a hot water hose and embodied such that said valve can be fastened to a connection member of the external hot water supply, and/or that the cold water valve is arranged at an upstream end of a cold water hose and embodied such that said valve can be fastened to a connection member of the external cold water supply. For this purpose, the hot water valve and/or the cold water valve can have, for example, connection threads which correspond to threads of common domestic water faucets. Valves of this type can be embodied in particular as Aquastop valves.

The arrangement of the hot water valve and/or the cold water valve at the upstream end of the water inlet device has the advantage that, even should damage occur, practically no leakage water can escape from the dishwasher as long as the valves are closed. If the valves are embodied in particular so as to close when no longer actuated, an escape of leakage water from a dishwasher that has been switched off is prevented in practically all cases. In order also to prevent the escape of leakage water from a switched-on dishwasher, a leakage water sensor can possibly be assigned to the program control device, for example, in the wash chamber or a collecting tank under the wash chamber, for detecting leakage water, so that the program control device can close the valves if there is an occurrence of leakage water during the operation of the dishwasher.

According to a preferred development of the invention, it is provided in particular that the linkage member is provided externally from the dishwasher and that the downstream end of the hot water hose and the downstream end of the cold water hose are linkable via the linkage member, in fluid-conducting manner, to an inlet hose which can be or is coupled to the device-side connection member, which is in particularly fixed to the housing of the dishwasher. Bringing the two water inlet devices for hot water and cold water of the water inlet device together in such a way is structurally easy to realize and significantly shortens the total hose length in many cases, particularly if the connection points of the external hot water supply and of the external cold water supply are further from the installation site of the dishwasher, since in such a case the provision of two relatively long parallel hoses can be dispensed with.

As an alternative to this external arrangement of the linkage member or conjunction piece outside the dishwasher, it may possibly be advantageous if the linkage member is firmly coupled to the device, particularly internally, to the device-side connection member or is integrally molded thereto. Said linkage member has a first one-sided connection branch for connecting the hot water hose and a second input-side connection branch for connecting the cold water hose. The external common inlet hose is therefore dispensed with. The linkage member can be mounted on or in the dishwasher from the beginning, particularly also in advance at the manufacturing plant. In particular, the connection member can be provided together with the linkage member in the region of the base assembly of the dishwasher, i.e. under the wash chamber thereof, on or in said wash chamber. Said connection member may preferably have a Y-shaped or F-shaped geometry.

The invention also concerns a method for controlling at least one wash cycle of a dishwasher, in particular a domestic dishwasher, comprising a hot water inlet device for the intake of hot water from an external hot water supply and a cold water inlet device for the intake of cold water from an external cold water supply, by means of at least one wash program of a program control device, the method being characterized in that at least one wash program is activated by the program control device in a first operating mode, wherein, for at least one partial wash cycle of the wash cycle implemented thereby, hot water is specifically drawn from the external hot water supply, and/or that at least one wash program is activated by the program control device in a second operating mode, wherein, for at least one partial wash cycle of the wash cycle implemented thereby, exclusively cold water is specifically drawn from the external cold water supply.

Other embodiments and developments of the invention are disclosed in the dependent claims. The advantageous embodiments and developments of the invention described above and/or disclosed in the dependent claims can be used individually or in any combination for the dishwasher and the method according to the invention.

BRIEF DESCRIPTION OF THE DRAWINGS

The invention, its embodiments and developments and their advantages will now be described with reference to drawings, in which.

DETAILED DESCRIPTION OF EXEMPLARY EMBODIMENTS OF THE PRESENT INVENTION

In the figures, parts which correspond to one another are identified by the same reference signs. Only those parts of a dishwasher that are necessary for an understanding of the invention are identified by reference signs and described. It is self-evident that the dishwasher according to the invention can comprise further parts and assemblies.

Figure 1:
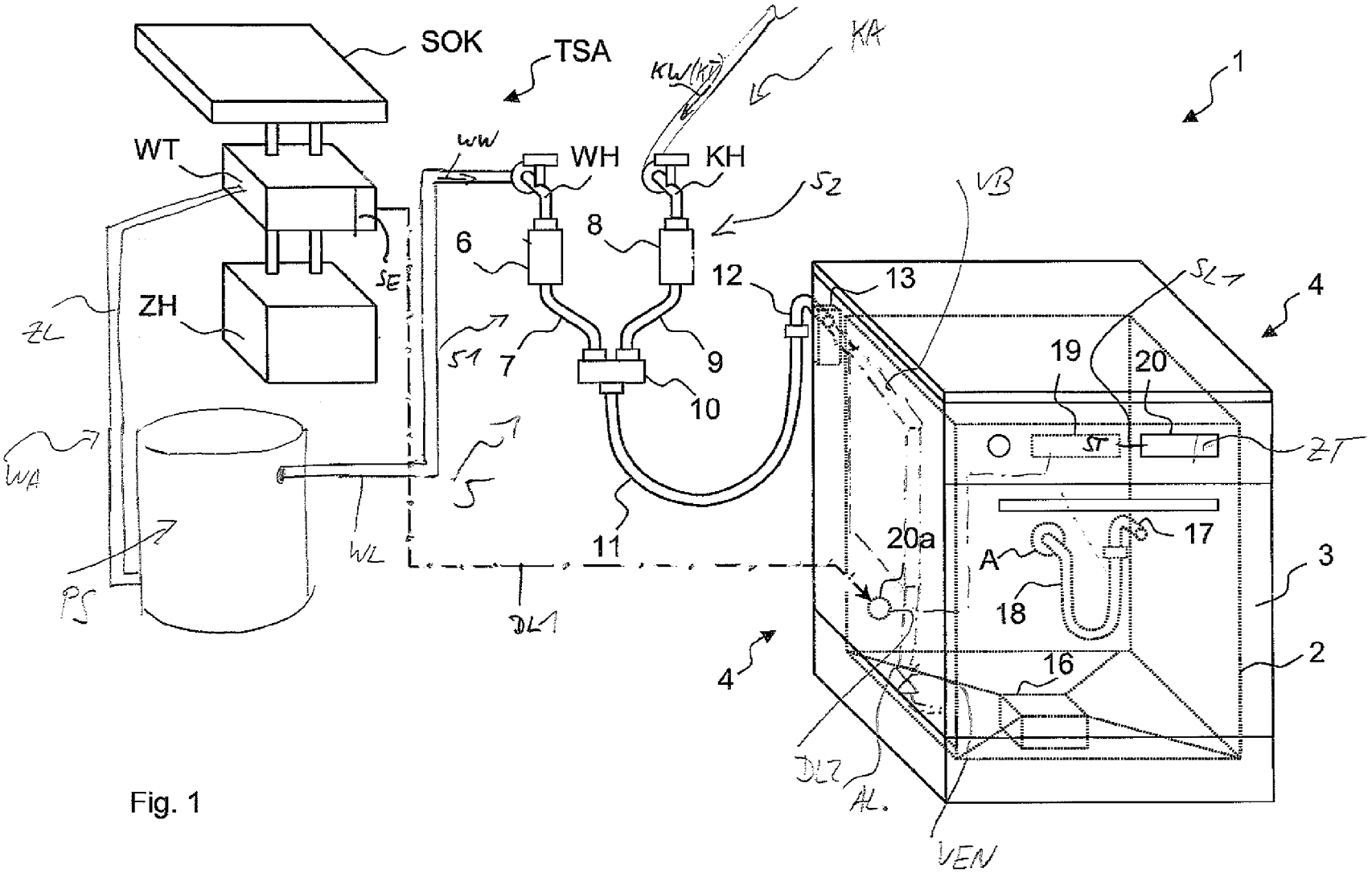
FIG. 1 is a schematic spatial representation of an advantageous exemplary embodiment of a dishwasher according to the invention.

FIG. 1 shows a schematic spatial representation of an advantageous embodiment of a dishwasher 1 according to the invention. Said dishwasher has a wash chamber 2 which is closable by means of a door 3 so that a wash cell for washing wash items is created. The wash chamber 2 is arranged in the interior of a housing 4 of the dishwasher 1 which can have standard dimensions. For example, the housing 4 can have a width of 45 cm or 60 cm, which enables integration of the dishwasher 1 into a standard configuration of kitchen units with a suitable installation niche. Said housing 4 can possibly be omitted partially or entirely, as in the case of built-in dishwashers, for example.

Arranged at the rear of the dishwasher 1 is a schematically shown water inlet device 5. Said inlet device has a hot water inlet device 51 and a cold water inlet device 52, the hot water inlet device 51 being provided for the intake of hot water from an external hot water supply WA and the cold water inlet device 52 being provided for the intake of cold water from an external cold water supply KA.

The hot water inlet device 51 comprises a controllable hot water valve 6 and the cold water inlet device 52 comprises a controllable cold water valve 8. In principle the hot water valve 6 and the cold water valve 8 are identical in design. For example, both valves 6, 8 can be embodied as solenoid valves. The inlet sides of the valves 6, 8 are each embodied such that the valves can be attached to connection members, for example, as here, to water faucets WH, KH of the typical household or building-side hot water supply WA and cold water supply KA. The connection can be made in each case by means a screw connector, a snap-fit connector or the like. Valves 6, 8 of this type can be embodied in particular as Aquastop valves. Advantageously, said valves are each closed when not actuated, such that in the switched-off state the dishwasher 1 is isolated from the hot water supply and the cold water supply. Thus, in the event of a fault, an escape of leakage water from the switched-off dishwasher 1 can be avoided.

In accordance with normal practice, the input side of the hot water valve 6 is connected in FIG. 1 to the hot water faucet WH and the input side of the cold water valve 8 is connected to the cold water faucet KH. The output side of the hot water valve 6 is in this case connected to a hot water hose 7 and the output side of the cold water valve 8 is connected to a cold water hose 9, the downstream ends of the hot water hose 7 and of the cold water hose 9 being connected to the input side of an external common linkage member 10. Connected to the output side thereof is a common inlet hose 11 for hot water and cold water which is connected, on one side, to a connection member 12 on the housing 4 of the dishwasher 1. It is therefore possible, by means of the water inlet device 5, to channel hot water WW from an external hot water supply WH and/or cold water KW from an external cold water supply KH, each individually controlled, into the interior of the dishwasher 1.

The hot water hose 7, the cold water hose 9 and/or the common inlet hose 11 can be embodied as safety hoses with an internal water-conducting pressure hose and an outer jacket hose, wherein a leakage water channel can be provided in each case between the pressure hose and the jacket hose to carry away any leakage water. The linkage member 10 can be embodied so that the leakage water channels of the hot water hose 7, the cold water hose 9 and the common inlet hose 11 are connected to one another such that leakage water occurring during the operation of the dishwasher 1 in the region of the water inlet device 5 is conducted via the connection member 12, fixed to the housing, into the interior of the dishwasher 1. Here, leaking can be detected by a leakage water sensor (not shown), so that appropriate measures such as closing the hot water valve 6 and the cold water valve 8 can be initiated.

The linkage member can be embodied in particular in a branch-like Y shape or as F-shaped or in some other geometrical form for bringing together the cold water hose 9 and the hot water hose 7 into a common conjunction pipe as, for example, 12.

As an alternative to said external arrangement of the linkage member 10 outside the dishwasher, it may be advantageous if the linkage member is coupled at the dishwasher, particularly inside the dishwasher, directly to the connection member 12 accommodated on the dishwasher side, particularly internally, or replaces said connection member 12. Said arrangement can be prepared, in particular in advance during manufacture. In this alternative beneficial embodiment variant, the external common inlet hose can be dispensed with. It may be beneficial here if the hot water hose 7 and the cold water hose 9 are already pre-mounted to said appliance-internal equipment component. In particular, the common linkage member can be provided on or in the dishwasher in the region of the base assembly thereof Provided downstream of the connection member 12 attached to the housing or of the internally provided linkage member 10, which where appropriate can replace the connection member 12, is a free flow section 13. The free flow section 13 is a pipe interrupter which serves to prevent back-suction of water from the dishwasher 1 if a negative pressure forms due to dynamic processes in the respective external water supply. In particular, this prevents already used water which may be laden with dirt, cleaning agents and/or cleaning aids passing back out of the wash chamber 2 into the building's water supply. In this way hygiene regulations concerning drinking water and/or process water supply networks can be reliably observed.

The dishwasher 1 also has components not shown in FIG. 1 which enable hot water WW and/or cold water KW to be channeled from the output of the free flow section 13 into the wash chamber 2.

Figure 2:
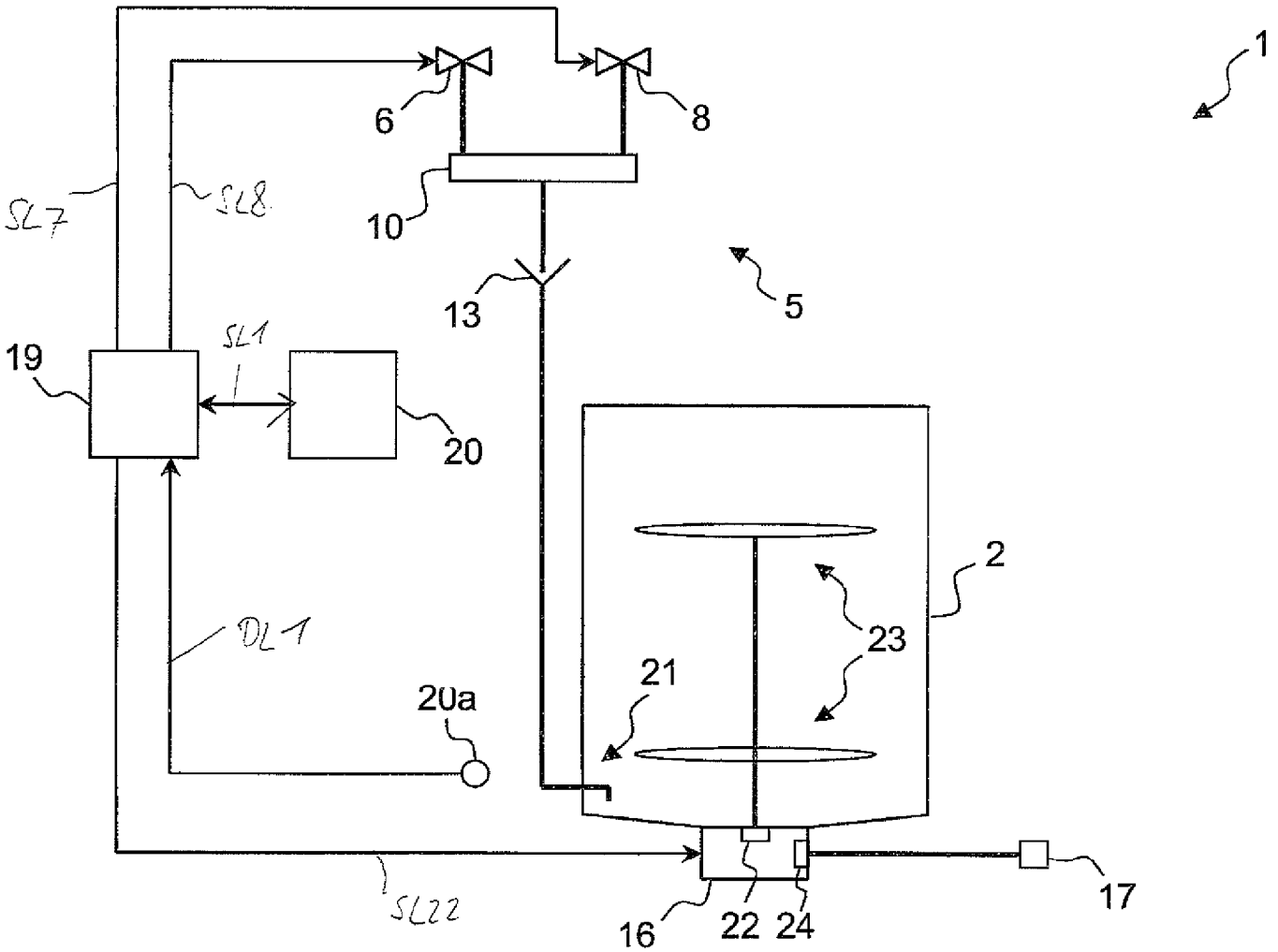
FIG. 2 is a block diagram of the dishwasher of FIG. 1.

Provided in a lower part of the wash chamber 2 is a pump housing 16 in which a circulation pump is beneficially mounted for the purpose of circulating the water in the wash chamber 2 during a wash cycle that is to be performed. The circulation pump can also include a heating device for heating the water in the wash chamber 2, a continuous-flow water heater for example. A waste water pump, particularly a drain pump, can also be provided in the pump housing 16 for pumping out water, at the end of a wash cycle for example. The different pump functions can also be performed where appropriate by means of a single pump in conjunction with switchable valves. The pump housing 16 is usually connected by means of a waste water connection member 17 via means (not shown) such that water can be pumped out of the wash chamber 2 via a waste water hose 18 connected to a waste water connection member 17 into a waste device A installed on the building side, for example, a waste pipe A. For the sake of simplicity of illustration the circulation pump and the waste water pump have been omitted in FIG. 1. Said pumps are shown in FIG. 2 and identified as 22, 24.

In FIG. 1, the hot water inlet device 51 of the dishwasher 1 is connected in accordance with normal practice to an external hot water supply WA which in the embodiment shown here is supplied with hot water WW in particular by a thermal solar installation TSA. The thermal solar installation TSA comprises one or more or a plurality of solar collectors SOK, only one of which is shown for space reasons. The solar collectors SOK each have an absorber surface (not shown) which can be heated by means of electromagnetic solar radiation. From said surface, the heat can be transported by means of a fluid to a heat exchanger WT which generates the hot water WW for the hot water supply WA. Said hot water can be channeled via an inlet pipe ZL and stored in particular in a buffer store PS and can be taken from said buffer store via a hot water pipe WL.

In order to be able to provide sufficient hot water in situations in which the heat energy provided by the solar collectors is not adequate, the hot water supply WA has, here in the exemplary embodiment, a conventional supplementary heating system ZH, for example a gas- or oil-fired boiler or a pellet-burning heating system or a heat pump system, which also supplies heat to the heat exchanger WT or can be connected directly via a supply line (not shown in FIG. 1) to the buffer store PS.

The dishwasher 1 also comprises a program control device 19 for controlling the sequence of a wash cycle according to a selected dishwashing program. In this case the program control device 19 has a first operating mode in which one or more wash programs can be activated and each perform a wash cycle such that for one or more partial wash cycles, the partial wash cycle sequence thereof is provided for the specific use of hot water WW from the hot water supply WA. The program control device also has a second operating mode in which one or more wash programs can be activated which are each converted into a wash cycle such that for the partial wash cycle sequence thereof, only cold water KW from the cold water supply KA is used.

The program control device 19 is connected to an operator control device 20 which, in this exemplary embodiment, is arranged on a control panel of the door 3 of the wash chamber 2. The program control device 19 itself is housed in the interior of the door 3. However, both could be arranged at a different location on the dishwasher 1. The operator control device enables the user to set the desired operating mode manually and to select manually an individual program from the programs available within the respectively selected operating mode. The operator control device 20 comprises, in particular, an auxiliary function button ZT for the manual selection of hot water intake from the hot water supply WA if, as here in the exemplary embodiment, said hot water supply is fed by the thermal solar installation TSA alone or exclusively, or supplies a predetermined minimum heat input to supplement the hot water quantity from an existing hot water provisioning installation.

Optionally, the dishwasher 1 can have a data interface 20*a* which is provided for receiving operating data from the hot water supply WA. For this purpose, said dishwasher can be connected via a data line DL1 to, for example, a control unit and/or sensor unit SE of the thermal solar installation TSE. In particular a temperature sensor can be provided as the sensor unit SE. The data line DL1 and the data interface 20*a* are additionally illustrated by a dash-dotted line in FIG. 1. The data interface 20*a* is also connected to the program control device 19 via a data line DL2 indicated by a dash-dotted line in FIG. 1. The program control device 19 can then beneficially be embodied for automatic selection of the operating mode based on the operating data provided by the control unit and/or sensor unit SE via the data lines DL1, DL2. Thus, it is for example possible for the dishwasher 1 to switch over automatically to the second operating mode if the heating output of the solar collectors SOK falls below a specific limit value ST, and to the first operating mode if the heating output of the solar collectors exceeds said limit value ST. It is also possible to control the operating mode automatically as a function of the temperature in the heat exchanger WT and/or the buffer store PS. Said control may be beneficial when the hot water supply is provided solely by the thermal solar installation TSA, i.e. when no auxiliary heating ZH is available. In this case the program control device 19 switches over to the second operating mode if the temperature of the hot water WW generated by the solar installation TSA undershoots a specific minimum temperature. It can also be provided that a changeover to the second operating mode takes place automatically when the auxiliary heating ZH is switched on. Here in the present exemplary embodiment, the control and/or sensor unit is associated particularly with the heat exchanger WT. Additionally or independently thereof, said control and/or sensor unit can also be associated with the buffer store PS.

FIG. 2 shows a schematic block diagram of the dishwasher 1 of FIG. 1. The hot water valve 6 and the cold water valve 8 are each connected to the program control device 19 via separate control lines SL6, SL8 such that both are individually controllable. It is therefore possible to supply the wash chamber 2 of the dishwasher 1, via the linkage member 10, the free flow section 13, and an outlet 21 with hot and/or cold water in a targeted manner.

Arranged in the pump housing 16 of the wash chamber 2 is the circulation pump 22 embodied as a heating pump which is connected to a spray system 23 arranged in the interior of the wash chamber 2. It is thus possible to spray wash items arranged within the wash chamber 2 with water during a wash cycle for the partial wash cycles thereof, in order to clean said wash items. Also arranged in the pump housing is the waste water pump 24 which enables water that is no longer needed to be pumped out into the waste pipe A. With the circulation pump 22, both the heating function and the pumping function are individually controllable by means of the program control device 19, as symbolized in FIG. 2 by a control line SL22. The program control device 19 is also connected in a suitable manner via at least one control line to the drain pump 24 for the control thereof. For clarity of illustration reasons said control line is also omitted in FIG. 2.

The operator control device 20 is connected via one or more control lines SL1 to the program control device 19 such that operating commands can be transmitted from the operator control device 20 to the program control device 19 (and vice versa). Toward that end the data interface 20*a* is connected to the program control device 19 via one or more data lines DL1 such that the operating data received from the data interface 20*a* in relation to the thermal solar installation TSA can be transmitted from the data interface 20*a* to the program control device 19.

The feeding of the dishwasher 1 with water is undertaken, like the control of the circulation pump 22 and of the drain pump 24 and other devices of the dishwasher 1 not described herein, depending on a selected dishwashing program. The wash programs are stored in the program control device 19, different wash programs being activatable according to the selected operating mode. In the first operating mode, at least one wash program is provided that is selectable specifically for efficient use of water heated by thermal solar energy.

Figure 3:
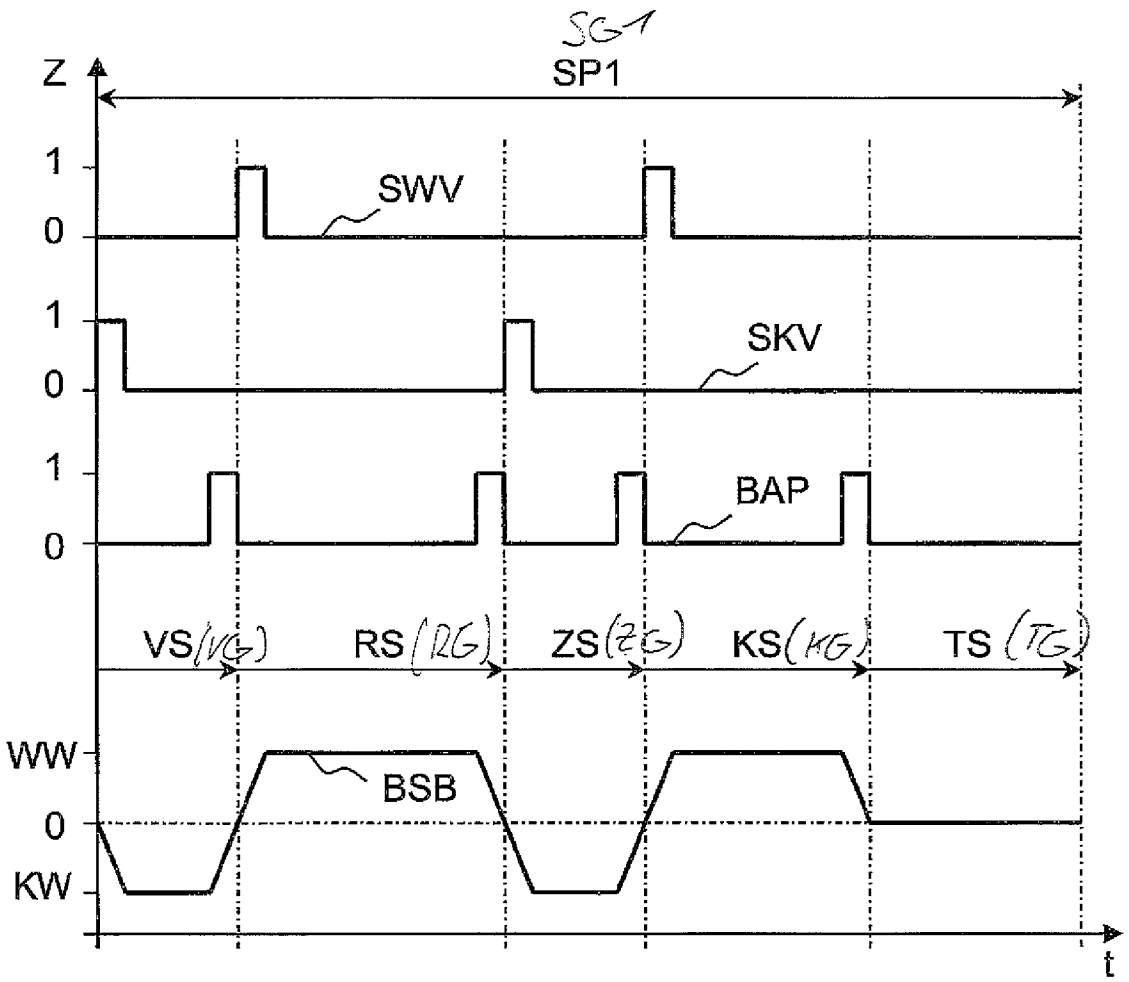
FIG. 3 shows a wash program of a first operating mode of the dishwasher of FIG. 1.

FIG. 3 shows an exemplary wash program SP1 of the dishwasher 1 of FIGS. 1 and 2, said program being selectable in the first operating mode. The wash program SP1 is provided in order to control a chronological sequence of a wash cycle when the hot water inlet device 51 of the dishwasher 1 is supplied with hot water heated by thermal energy in a thermal solar installation TSA. Here in the exemplary embodiment, said program comprises, in this chronological sequence, a pre-wash step VS, a subsequent cleaning step RS, a subsequent intermediate rinsing step ZS, a subsequent final rinsing step KS and a final drying step TS. The wash program SP1 correspondingly implements, as partial wash cycles, a pre-wash cycle VS, a cleaning cycle RG, an intermediate rinsing cycle ZG, a final rinsing cycle and a final drying cycle TG of an associated wash cycle SG1. The pre-wash cycle VG, the cleaning cycle RG, the intermediate rinsing cycle ZG and the final rinsing cycle all use fluid.

In FIG. 3, the curves SWV, SKV, BAP and BSB which illustrate switching and/or operating states of components of the dishwasher 1 on the vertical axis Z are plotted over a common time axis t.

The curve SWV represents the switching state of the hot water valve 6 of the dishwasher 1. Next, the curve SKV shows the switching state of the cold water valve 8 of the dishwasher 1. The switching state "0" corresponds in each case to a closed valve 6, 8, while the switching state "1" represents an opened valve 6, 8. Next, the curve BAP represents the operational state of the waste water pump 24, the switched-off state being symbolized by "0" and the switched-on state by "1". Finally, the curve BSB shows the fill state of the wash chamber 2 with water. Here, a wash chamber 2 loaded with hot water from the hot water supply WH is represented by "WW", a wash chamber 2 loaded with cold water from the cold water supply KH is represented by "KW" and an empty wash chamber 2 is represented by "0".

The wash program SP1 in the exemplary embodiment here is preferably a typical normal wash program which is provided for cleaning normally soiled wash items. In other examples, one or more of these steps can be omitted. Furthermore, examples such as an intensive wash program are possible, wherein one or more steps are repeated multiple times.

The pre-wash step VS performed first serves to remove the heaviest soiling from the dishes in a pre-wash cycle in order to prepare for the cleaning step RS. For this purpose, at the start of the pre-wash step VS, the cold water valve 8 is opened until the wash chamber 2 is filled with a sufficient quantity of cold water KW from the cold water supply KA. This cold water is circulated by the circulation pump 22 for a predetermined time, usually without the heating device thereof being switched on, in order to apply cold water KW to the wash items. Thereafter, the now dirty cold water is pumped out by means of the waste water pump 24.

Using cold water KW from the cold water supply KA during the pre-wash step VS for performing the pre-wash step VG is easily possible because the loosening of coarser dirt is performed substantially mechanically, so that in many cases high temperatures can be dispensed with during the pre-wash step. Thus, subsequent heating by means of the heating device of the circulation pump 22 can be omitted or possibly carried out with a low electrical energy input. At the same time the heat energy drawn from the hot water supply WH can thus be reduced without the cleaning result being noticeably worsened.

The cleaning step RS carried out next serves for thorough cleaning of the wash items in a cleaning cycle RG. For this purpose, at the start of the cleaning step RS, the hot water valve 6 is opened until the wash chamber 2 has been loaded with a sufficient quantity of hot water WW from the hot water supply WA. The hot water WW taken into the wash chamber 2 is now circulated with the aid of the circulation pump 22 for a predetermined time in order to apply hot water to the wash items. At the same time the heating device of the circulation pump 22 can be switched on depending on the temperature of the supplied hot water and depending on the intended wash temperature of the cleaning step RS, as needed, if the water inlet temperature from the hot water supply WA is below a desired setpoint temperature for the wash bath of the cleaning cycle RG. At the conclusion of the cleaning step RS, the now dirty hot water is pumped out by means of the waste water pump 24.

During the cleaning step RS, it is normally necessary to apply to the wash items water that has a relatively high temperature in order to achieve a high thermal cleaning effect. In addition, a cleaning agent is usually added to the water, the chemical cleaning effect of which is best at a higher temperature. In particular, a wash bath setpoint temperature in the range of approximately 50° C. to 70° C. is selected for the cleaning step RS. When hot water WW from the thermal solar installation TSA is used for the cleaning step RS, it is therefore ensured that the heat energy drawn from the solar installation TSA is effectively utilized without the further use of energy through the appliance-internal heating device of the dishwasher 1 and without a further heating device of the external hot water supply WA being used. Precisely in this way, a large saving of electrical energy can be achieved here since the hot water from the thermal solar installation TSA does not need to be further heated by the electric heating device of the dishwasher 1 in many cases, and only slightly in other cases, in order to achieve the required setpoint wash bath temperature for the cleaning cycle RG.

The now performed intermediate rinsing step ZS for removing cleaning agent from the wash items following the rinsing step RS in an intermediate rinsing cycle RG also makes provision for loading the wash chamber 2 with cold water KW from the cold water supply KA in order to be able to apply cold water to the wash items. For this purpose the cold water valve 8 is first opened until the wash chamber 2 has been filled with a sufficient quantity of cold water for the intermediate rinsing step ZS. This cold water is circulated by the circulation pump 22 for a predetermined time, there normally being no need for the pump's heating device to be switched on. The now dirty cold water is then pumped out by the waste water pump 24.

During the intermediate rinsing step ZS, higher temperatures are normally not needed, so that cold water from the cold water supply can also be used in the intermediate rinsing step ZS, without said cold water having to be heated, with a higher electrical energy input, by means of the heating device of the circulation pump 22. At the same time the quantity of heat energy drawn from the hot water supply WA can be further reduced without the cleaning result being adversely affected.

In the now following final rinsing step KS for performing a final rinsing cycle KG, provision is made for the application of hot water WW from the hot water supply WA to the wash items. For this purpose, firstly the hot water valve 6 is opened again until the wash chamber 2 is filled with a sufficient quantity of hot water WW from the hot water supply WA for the final rinsing step KS. The hot water loaded into the wash chamber 2 is then circulated with the aid of the circulation pump 22 for a predetermined time in order thereby to apply hot water to the wash items. During the final rinsing step KS also, the heating device of the circulation pump 22 can be switched on as needed depending on the temperature of the supplied hot water and depending on its intended rinsing temperature. If the inlet temperature of the hot water WW is equal to or above the minimum temperature desired for the final rinsing cycle KG, the heating device of the circulation pump 22 can advantageously remain switched off or deactivated. If the inlet temperature of the hot water is below the required minimum temperature, the electric heating device of the liquid circulation system of the dishwasher can be switched on in order to reheat the water. In any event, through the use of the hot water, the energy consumption of the dishwasher can be reduced. At the end of the final rinsing step KS, the now dirty hot water is pumped out by means of the waste water pump 24.

A final rinsing step KS serves, in particular to prevent spots which can form on the wash items due to dissolved substances in the water, such as salt and/or lime. For this purpose a rinse aid is added to the water during the final rinsing step KS. A further purpose of the final rinsing step KS is to prepare for the subsequent drying cycle TG in the drying step TS. During the final rinsing step KS, the dishes are heated in that particularly hot water at a temperature in the range of, for example, 60° C. to 75° C. is used. By this means, during the subsequent drying step TS, water drops adhering to the hot dishes evaporate and condense on the inside of the wash chamber 2 due to the lower temperature prevailing there. When hot water from the solar installation TSA is used for the final rinsing step KS, it is therefore also ensured that the heat energy drawn from the solar installation TSA is effectively utilized. In this case, also, a large saving of electrical energy can be achieved since the hot water from the solar installation TSA is heated to a temperature high enough that in many cases no further heating by means of the electrical heating device in the liquid circulation system of the dishwasher 1 is necessary, while in other cases further heating is necessary only to a small extent, in order to achieve the temperature required for the final rinsing step KS.

During the concluding drying step TS no provision is made for filling the wash chamber 2 with water.

Furthermore, it can be particularly beneficial if, during the first operating mode, i.e. with intake of hot water from the external hot water supply WA, for the drying cycle TG, cold water KW is supplied from the external cold water supply WA into a heat exchanger provided externally, particularly in the form of a water pocket or a reservoir VB, following the end of the final rinsing cycle KG. Said reservoir VB is illustrated by a dash-dotted line on a wall in FIG. 1, particularly a side wall of the wash chamber 2. Said reservoir is connected to the wash chamber 2 in heat-conducting manner, for example, by contact. Said reservoir is connected downstream of the connection member 12 fastened to the housing and the free flow section 13 and has an outflow into the wash chamber 2 which for clarity of illustration reasons is not shown in FIG. 1. Due to the filling of said heat exchanger with cold water, the wall surface of the wash chamber contacted thereby is cooled during the drying process and the condensation of liquid on the inner wall surface of the wall of the wash chamber provided externally with the heat exchanger can be improved, so that an improved drying result follows therefrom.

In the event that only hot water from the external hot water supply is used for all the water-conducting partial wash cycles of the selected dishwashing program because, for example, no cold water connection, but only a hot water connection is available or because a wash program has been selected by means of the operator control device of the dishwasher, particularly by manual pressing of the auxiliary function button ZT for external water intake, which provides only, that is, exclusively a hot water intake for all the partial wash cycles of said program, it is useful if the heat exchanger is not filled with hot water at the end of the final rinsing cycle, but remains empty, that is, unfilled during the drying cycle. Toward that end, the outlet valve VEN in the outlet AL of the reservoir VB is not closed at the end of the final rinsing cycle KG as in the case of a purely cold water connection, but remains open so that the incoming hot water can run into the wash chamber and the heat exchanger or reservoir VB remains empty. By this means, firstly, any worsening of the condensation on the inner walls of the wash chamber during the drying cycle is prevented by an additional quantity of heat as compared with the case of a dishwasher that has no heat exchanger at all. Secondly, the possibility is prevented that hot water which would have been loaded into the heat exchanger as a filling at the end of the final rinsing cycle would have cooled down to ambient temperature by the start of the next wash program and would be fed as "now gone cold" water to the wash bath for the pre-wash cycle or cleaning cycle of said next wash cycle, leading to an impairment of a possibly desired heating process during the pre-wash cycle and/or cleaning cycle.

Figure 4:
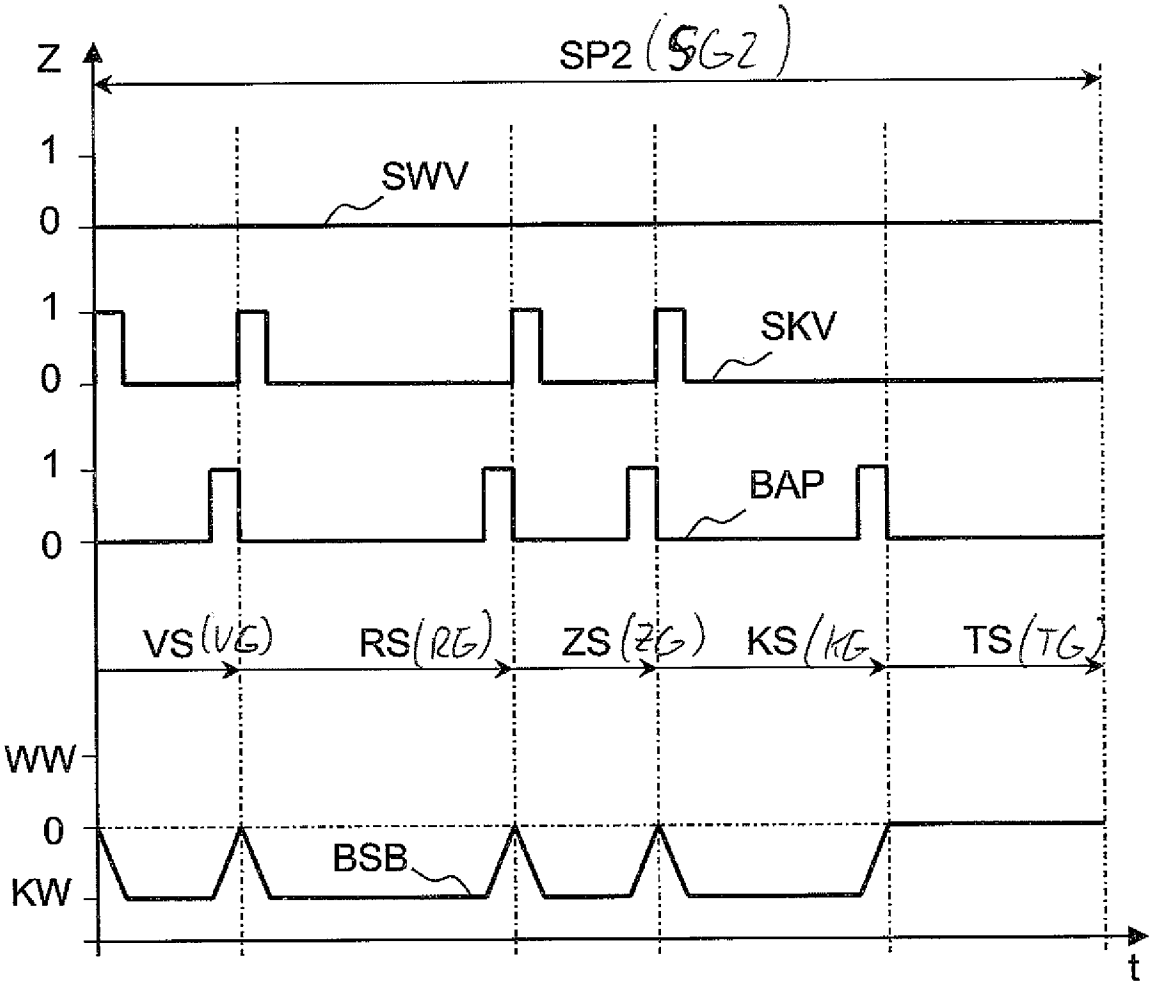
FIG. 4 shows a wash program of a second operating mode of the dishwasher of FIG. 1.

FIG. 4 shows an exemplary wash program SP2 of the dishwasher 1 of FIGS. 1 and 2 which is selectable in an advantageous embodiment variant of the second operating mode. The wash program SP2 is intended for control an execution sequence of a wash cycle when the hot water supply WA is supplied with hot water WW produced by the auxiliary heating ZH and the heat energy provided by the solar installation TSA makes too small a contribution.

The wash program SP2 or the wash cycle SG2 associated therewith likewise involves a normal wash program, said program corresponding to the normal wash program SP1 described above or to its associated wash cycle SG1 so as to comprise a substantially identical cleaning and drying effect.

The difference lies particularly in the fact that the wash program SP2 now exclusively makes provision for the use of cold water KW from the cold water supply KA because the heat input to the total volume of the buffer store PS is too small in relation to the contribution made by the heating system ZH. This avoids heat energy being drawn from the hot water supply WA when, for example, the solar collectors SOK supply too little heat energy. In program steps RS, KS in which it is required or desirable to apply water at a higher temperature to the wash items, i.e. particularly in the cleaning step RS and in the final rinsing step KS, the water provided for applying to the wash items can be heated solely, that is, exclusively by means of the continuous-flow water heater of the circulation pump 22, or expressed in general terms, by means of an electric heating device in the liquid circulation system of the dishwasher. The additional costs incurred for the electrical energy are in many cases lower than the additional costs that would arise if the supplementary heating ZH of the external hot water supply WA had to be switched on due to additional hot water being drawn off.

As soon as the user makes provision by means of the operator control device 20, particularly by deactivating its auxiliary function button ZT, for an exclusively cold water intake for the partial wash cycles of a desired wash program, the program control device 19 of the dishwasher 1 therefore ensures that only cold water from the cold water line is fed in for the wash baths in all the partial wash cycles of the wash cycle of the selected dishwashing program. For the partial wash cycles for the respective wash bath quantity of which a specific minimum setpoint temperature higher than the cold water temperature is required, the cold water quantity to be introduced for the respective wash bath is heated by means of the heating device of the liquid circulation system, particularly the circulation pump, of the dishwasher and brought to the desired specific minimum or setpoint temperature.

In said second operating mode, it is beneficial if the heat exchanger VB is filled with cold water KW following the end of the final rinsing step, so that during the drying step, the heat exchanger remains filled with cold water such that the heat-conducting surface of the wash chamber contacted by said heat exchanger or otherwise connected in heat-conducting manner therewith is cooled to improve the condensation effect.

In an advantageous exemplary embodiment, the invention concerns a dishwasher having an auxiliary function button, preferably for selecting hot water intake from an additional hot water supply system which is fed partially or entirely by, in particular, alternative energy sources such as a hot water solar installation. Beneficially, two water connections or water inlet devices are provided which are separately controllable by means of one valve each, particularly an Aquastop valve. In other words, the dishwasher has a bithermal water connection with hot water inlet and cold water inlet. Thus, one water connection is provided for hot water, particularly hot, economical solar energy-heated water, and another water connection is provided for cold water from the cold water mains network. Both water connections can be selected individually or specifically via a control system of the dishwasher. After the two valves, the water then flows via a connecting piece or junction piece, possibly via a common feed pipe, to a water inlet system of the dishwasher which is connected to the liquid circulation system of said dishwasher.

On this basis of hot and cold water connections, i.e. two water connections, the dishwasher now beneficially has an auxiliary function button (ZT in FIG. 1) (solar button) which can be arranged, in particular, on the panel, or preferably control panel, of the dishwasher. Upon actuation of said button, special wash sequences comprising wash steps can be activated in the control unit or program control device that are embodied for any ready, available hot water from the hot water supply, particularly a solar hot water system.

The manual selection by means of the auxiliary button can possibly be dispensed with if the information concerning by which means or operating mode—e.g. solar or e.g. with heating oil—heating is currently being undertaken, is transmitted to the dishwasher, e.g. by data transfer.

The aim of said special wash programs of the dishwasher embodied according to the invention is, in particular, to keep the washing and drying performance of the dishwasher preferably always largely constant with the lowest energy utilization without the user having to think about changing over the water connection. It is therefore not necessary to connect the cold water hose to the hot water faucet for the intake of hot water. Nor is it necessary to reconnect said cold water hose for the intake of cold water.

The dishwasher embodied according to the invention is now able to respond in various ways to change requests in respect of cold and hot water intake by actuation of the operator control device, particularly by pressing the auxiliary function button, in order to fulfill the aim of achieving good washing and drying performance in the most energy-saving manner possible. The customer can, in particular personally, switch over the dishwasher in the summer months during poor weather or during the transition to the winter months, by deactivating the auxiliary button, to cold water operation if too little energy is fed into the hot water store from the solar hot water system.

As soon as the user has pressed, i.e. activated, the auxiliary function button or, expressed in more general terms, has actuated the operator control device accordingly, the program control device of the dishwasher embodied according to the invention ensures, according to an advantageous operating mode variant, that for the wash baths of the partial wash cycles, such as e.g. cleaning cycle and final rinsing cycle, of a wash cycle of a selected dishwashing program, wherein in each case a specific minimum temperature higher than the cold water temperature KT is required, hot water is used from the available additional hot water supply that is coupled, in particular, to a thermal solar installation and that, for the wash baths in the partial wash cycles of the wash cycle in which cold water alone suffices, only cold water from the cold water supply is used, without any additional heating overhead.

List of reference signs

1 Dishwasher
2 Wash chamber
3 Door
4 Housing
5 Water inlet device
6 Hot water valve
7 Hot water hose
8 Cold water valve
9 Cold water hose
10 Linkage member
11 Inlet hose
12 Connection member fastened to housing
13 Free flow section
16 Pump housing
17 Waste water connection member
18 Waste water hose
19 Program control device
20 Operator control device
20*a* Interface
21 Outlet
22 Circulation pump with continuous-flow water heater
23 Spray device
24 Drain pump, waste water pump
51 Hot water inlet device
52 Cold water inlet device
A Waste pipe
BAP Operating state, waste water pump
BSB Fill state of wash chamber
DL1, DL2 Data lines
KA Cold water supply
KH Cold water faucet
KG Final rinsing cycle
KS Final rinsing step
KT Cold water temperature
PS Buffer store
RS Cleaning step
RG Cleaning cycle
SOK Solar collector
SE Control and/or sensor unit
SG1, SG2 Wash cycles
SKV Switching state of the cold water valve
SL1, SL7, SL8, SL22 Control lines
SP1 Wash program of the first operating mode
SP2 Dishwashing programs of the second operating mode
ST Minimum temperature
SWV Switching state of the hot water valve
TG Drying cycle
TS Drying step
TSA Thermal solar installation
VS Pre-wash step
VG Pre-wash cycle
WA Hot water supply
WH Hot water faucet
WL Hot water pipe
WT Heat exchanger
ZH Auxiliary heating
ZG Intermediate rinsing cycle
ZL Inlet pipes
ZS Intermediate rinsing step
ZT Auxiliary button

The invention claimed is:

1. A method for controlling at least one wash cycle of a dishwasher, comprising:

activating one of first and second operating modes based upon a determination of which of the first operating mode and the second operating mode is more efficient, wherein in the first operating mode a wash program is activated by a program control device to draw hot water from an external hot water supply to execute at least one partial wash cycle of a wash cycle;

wherein in the second operating mode another wash program is activated by the program control device to draw exclusively cold water from an external cold water supply to execute at least another partial wash cycle of the wash cycle, wherein the wash program and the other wash program are each complete wash programs for cleaning dishes, and wherein the determination of which of the first operating mode and the second operating mode is more efficient is based upon whether it is more economical to draw heated water from the external hot water supply or whether it is more economical to heat water in the dishwasher.

2. A method for controlling at least one wash cycle of a dishwasher, comprising:

activating one of first and second operating modes based upon a determination of which of the first operating mode and the second operating mode is more efficient, wherein in the first operating mode a wash program is activated by a program control device to draw hot water from an external hot water supply to execute at least one partial wash cycle of a wash cycle;

wherein in the second operating mode another wash program is activated by the program control device to draw exclusively cold water from an external cold water supply to execute at least another partial wash cycle of the wash cycle, and wherein the wash program and the other wash program are each complete wash programs for cleaning dishes; and switching from the first operating mode to the second operating mode when water temperature from the external hot water supply falls below a predetermined limit.

3. The method of claim 2 for controlling at least one wash cycle of a domestic dishwasher.

4. The dishwasher of claim 2, wherein the determination of which of the first operating mode and the second operating mode is more efficient is based upon whether it is more economical to draw heated water from the external hot water supply or whether it is more economical to heat water in the dishwasher.

5. The dishwasher of claim 2, wherein the first operating mode and the second operating mode have the same cleaning effect but parameters of operation are varied based upon whether hot or cold water is drawn.

6. The method of claim 2, further comprising heating the cold water during the other partial wash cycle using a heater internal to the dishwasher.

7. A dishwasher, comprising a hot water inlet device for intake of hot water from an external hot water supply;

a cold water inlet device for intake of cold water from an external cold water supply; and a program control device programmed to control a wash cycle of a selected dishwashing program for cleaning wash items, said program control device being programmed to operate in first and second operating modes, wherein the first operating mode includes activation of one wash program which, in at least one first partial wash cycle of a first wash cycle, draws hot water from the external hot water supply, wherein the second operating mode includes activation of another wash program which, in at least one second partial wash cycle of a second wash cycle, exclusively draws cold water from the external cold water supply, wherein the program control device is programmed to select the first operating mode or the second operating mode based upon a determination of which of the first operating mode and the second operating mode is more efficient, wherein the one wash program and the other wash program are each complete wash programs for cleaning dishes, and wherein the program control device switches from the first operating mode to the second operating mode when water temperature from the external hot water supply falls below a predetermined limit.

8. A dishwasher, comprising a hot water inlet device for intake of hot water from an external hot water supply;

a cold water inlet device for intake of cold water from an external cold water supply; and a program control device programmed to control a wash cycle of a selected dishwashing program for cleaning wash items, said program control device being programmed to operate in first and second operating modes, wherein the first operating mode includes activation of one wash program which draws hot water from the external hot water supply and cold water from the cold water supply in different wash cycles, wherein the second operating mode includes activation of another wash program which exclusively draws cold water from the external cold water supply for all wash cycles, wherein the program control device is programmed to select the first operating mode or the second operating mode based upon a determination of which of the first operating mode and the second operating mode is at least one of more economically efficient and more cleaning efficient, and wherein the one wash program and the other wash program are each complete wash programs for cleaning dishes.

9. The dishwasher of claim 8, further comprising a water heater, wherein the second operating mode comprises at least one wash cycle where the external cold water is heated with the water heater.

10. A dishwasher, comprising a hot water inlet device for intake of hot water from an external hot water supply;

a cold water inlet device for intake of cold water from an external cold water supply; and a program control device programmed to control a wash cycle of a selected dishwashing program for cleaning wash items, said program control device being programmed to operate in first and second operating modes, wherein the first operating mode includes activation of one wash program which, in at least one first partial wash cycle of a first wash cycle, draws hot water from the external hot water supply, wherein the second operating mode includes activation of another wash program which, in at least one second partial wash cycle of a second wash cycle, exclusively draws cold water from the external cold water supply, wherein the program control device is programmed to select the first operating mode or the second operating mode based upon a determination of which of the first operating mode and the second operating mode is more efficient, wherein the one wash program and the other wash program are each complete wash programs for cleaning dishes, and wherein the determination of which of the first operating mode an the second operating mode is more efficient is based upon whether it is more economical to draw heated water from the external hot water supply or whether it is more economical toheat water in the dishwasher.

11. A dishwasher, comprising a hot water inlet device for intake of hot water from an external hot water supply;

a cold water inlet device for intake of cold water from an external cold water supply; and a program control device programmed to control a wash cycle of a selected dishwashing program for cleaning wash items, said program control device being programmed to operate in first and second operating modes, wherein the first operating mode includes activation of one wash program which, in at least one first partial wash cycle of a first wash cycle, draws hot water from the external hot water supply, wherein the second operating mode includes activation of another wash program which, in at least one second partial wash cycle of a second wash cycle, exclusively draws cold water from the external cold water supply, wherein the program control device is programmed to select the first operating mode or the second operating mode based upon a determination of which of the first operating mode and the second operating mode is more efficient, wherein the one wash program and the other wash program are each complete wash programs for cleaning dishes, and wherein the determination of which of the first operating mode and the second operating mode is more efficient is based upon whether it is more economical to draw heated water from the external hot water supply or whether it is more economical to heat water in the dishwasher.

12. The dishwasher of claim 11, constructed in the form of a domestic dishwasher.

13. The dishwasher of claim 11, wherein the one wash program in the first operating mode provides at least one program step for washing wash items using hot water from the external hot water supply.

14. The dishwasher of claim 11, wherein the one wash program in the first operating mode provides at least one program step for use of cold water from the external cold water supply.

15. The dishwasher of claim 11, wherein the program control device is programmed to control the hot water inlet device and the cold water inlet device such that for a first group of one or more partial wash cycles of the wash cycle performed by the selected dishwashing program, for each of which a specific wash bath hot water temperature higher than a temperature of the cold water from the external cold water supply is required, hot water is fed from the external hot water supply via the hot water inlet device into a wash chamber, specific to the partial wash cycle, and for a second group of one or more partial wash cycles of the wash cycle of the selected dishwashing program, for which a cold water temperature of cold water from the external cold water supply is sufficient or required as a respective specific wash bath hot water temperature, cold water is fed from the external cold water supply via the cold water inlet device into the wash chamber, specific to the partial wash cycle.

16. The dishwasher of claim 11, further comprising an operator control device to enable manual selection of the first and second operating modes.

17. The dishwasher of claim 11, further comprising a data interface adapted to receive operating data of the external hot water supply, said program control device being programmed to select the first and second operating modes based on received operating data.

18. The dishwasher of claim 11, wherein the external hot water supply is partially or wholly fed by a thermal solar installation.

19. The dishwasher of claim 11, wherein the first operating mode and the second operating mode have the same cleaning effect but parameters of operation are varied based upon whether hot or cold water is drawn.

20. The dishwasher of claim 11, wherein the program control device switches from the first operating mode to the second operating mode when water temperature from the external hot water supply falls below a predetermined limit.

21. The dishwasher of claim 11, further comprising a linkage member having first and second inputs, wherein the hot water inlet device is constructed for coupling to the first input and the cold water inlet device is constructed for coupling to the second input of the linkage member.

22. The dishwasher of claim 21, wherein the linkage member is placed internally at the dishwasher.

23. The dishwasher of claim 11, wherein the hot water inlet device comprises a hot water valve, and the cold water inlet device comprises a cold water valve, said program control device controlling the hot water valve and the cold water valve independently of one another.

24. The dishwasher of claim 23, wherein the hot water valve is arranged at an upstream end of a hot water hose and embodied such that the hot water valve is securable to a connection member of the external hot water supply, and/or the cold water valve is arranged at an upstream end of a cold water hose and embodied such that the cold water valve is securable to a connection member of the external cold water supply.

25. The dishwasher of claim 24, further comprising a linkage member placed externally from the dishwasher, wherein the downstream end of the hot water hose of the hot water inlet device and the downstream end of the cold water hose of the cold water inlet device are linkable via the linkage member, in fluid-conducting manner, to a common inlet hose constructed for coupling to a device-side connection member.

26. The dishwasher of claim 25, further comprising a housing, said device-side connection member being fixed to the housing.

* * * * *